United States Patent [19]
Wolf et al.
[11] 4,442,028
[45] Apr. 10, 1984

[54] METHOD FOR INCORPORATING RADIOACTIVE PHOSPHORIC ACID SOLUTIONS IN CONCRETE

[75] Inventors: Gary A. Wolf, Kennewick, Wash.; Jeffrey W. Smith, Lancaster, Ohio; Nathan C. Ihle, Walla Walla, Wash.

[73] Assignee: The United States of America as represented by the United States Department of Energy, Washington, D.C.

[21] Appl. No.: 396,192

[22] Filed: Jul. 8, 1982

[51] Int. Cl.[3] ..... G21F 9/10; G21F 9/11
[52] U.S. Cl. ..... 252/628; 252/631
[58] Field of Search ..... 252/628, 631

[56] References Cited

U.S. PATENT DOCUMENTS 3,330,771 7/1967 Komatsu ..... 252/631
3,764,553 10/1973 Kirby ..... 252/631
4,113,504 9/1978 Chen ..... 106/97
4,122,028 10/1978 Iffland ..... 252/631
4,330,514 5/1982 Nagai ..... 423/309

OTHER PUBLICATIONS

Tallart, D. R., SAND-78-2270C, "Application of Inorganic Sorbent in Actinide Separation Processes," Abstract from Energy Research Abstracts, vol. 4, No. 11, 1979.

*Primary Examiner*—Deborah L. Kyle
*Assistant Examiner*—Virginia Caress
*Attorney, Agent, or Firm*—Robert Southworth, III; Richard E. Constant; Michael F. Esposito

[57] ABSTRACT

A method for incorporating radioactive phosphoric acid solutions in concrete is described wherein the phosphoric acid is reacted with $Ca(OH)_2$ to form a precipitate of hydroxyapatite and the hydroxyapatite is mixed with portland cement to form concrete.

5 Claims, 1 Drawing Figure

METHOD FOR INCORPORATING RADIOACTIVE PHOSPHORIC ACID SOLUTIONS IN CONCRETE

The U.S. Government has rights in this invention pursuant to Contract No. DE-AC06-77RL01030 between the U.S. Department of Energy and Rockwell International.

BACKGROUND OF THE INVENTION

The invention relates generally to the treatment of radioactive solutions and, more particularly to a method for incorporating radioactive phosphoric acid solutions in concrete.

Operations with nuclear facilities may generate radioactive phosphoric acid solutions. For example, the primary cooling system in the N-reactor at Hanford, Wash. is decontaminated by circulating 6% phosphoric acid through the coolant piping. In a typical year 500,000 gallons of phosphoric acid are produced. It has been proposed to neutralize this waste with NaOH and incorporate it into concrete. This approach suffers the disadvantage of forming a soluble $Na_2HPO_4$ species and only achieving a waste loading of from 5% to 15%.

It is accordingly a general object of the invention to provide a method for incorporating a radioactive phosphoric acid waste into concrete in which the phosphoric acid is first converted into an insoluble compound.

Another object of the invention is to provide a method for incorporating radioactive phosphoric acid waste into concrete in a manner achieving a high waste loading.

Other objects, advantages and novel features of the invention will be apparent to those of ordinary skill in the art upon examination of the following detailed description of a preferred embodiment of the invention and the accompanying drawing.

SUMMARY OF THE INVENTION

A method is provided for incorporating radioactive phosphoric acid waste into concrete. Insoluble hydroxyapatite is precipitated from the solution by reaction with $Ca(OH)_2$. The resulting precipitate is mixed with portland cement to form concrete.

BRIEF DESCRIPTION OF THE DRAWING

The FIGURE is a flowsheet of the method of the invention.

DESCRIPTION OF THE PREFERRED EMBODIMENT

Figure 1:
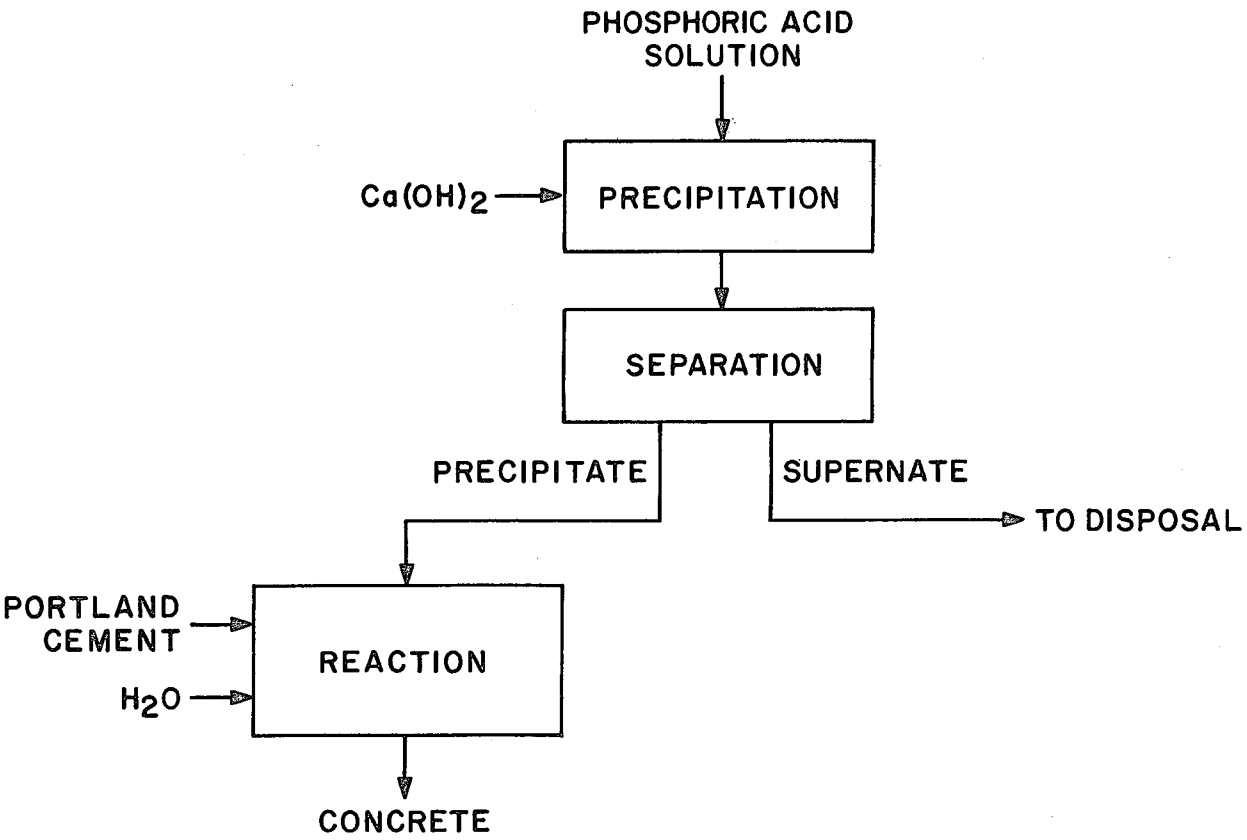

Turning now to the drawing which illustrate the method of the invention, it is seen that the waste phosphoric acid solution is brought into contact with $Ca(OH)_2$ to effect a precipitation. The amount of $Ca(OH)_2$ is proportioned stoichiometrically to produce a precipitate of $Ca_{10}(PO_4)_6(OH)_2$. This compound is a mineral known as hydroxyapatite and is extremely insoluble in water. Other alkali substances, such as NaOH, may be added to control the pH balance of the precipitation. It has been found that a pH of about 10 will result in finely divided precipitate which is readily pumpable. A pH of from 7.5 to 8.5 has been found to allow the precipitate crystals to agglomerate or otherwise grow to sizes where they can readily settle or be filtered out.

The precipitate may then be separated from the supernate by such well known operations as filtration or decantation. Generally, radionuclides which may be present will precipitate with and be incorporated in the hydroxyapatite and the supernate may then be discarded.

The precipitate may then be dried and crushed to remove large lumps. The precipitate is then mixed with portland cement in a ratio of from 3:1 to 1:1 precipitate to cement. Sufficient water is then added (if not already present) to make a pourable concrete mix. The mixture is then cast in any desired shape and allowed to cure for approximately seven days or until the cast shape has enough mechanical strength for permanent disposal.

EXAMPLE

A synthetic 6% phosphoric acid waste solution was spiked to a cobalt-60 concentration of 200 uCi/1. This solution was then neutralized with a stoichiometric amount of $Ca(OH)_2$ as the pH was adjusted to 7.8 with NaOH. The resulting precipitate had a cobalt-60 activity of 1028 uCi/Kg while the supernate had an activity of only 1–3 uCi/1.

Aliquots of the precipitate were mixed with portland cement in ratio of 3 parts precipitate to 1 part cement and equal parts precipitate and cement and then hydrated. The resulting samples were tested for durability by leaching for 3 days in 40° C. water. The leach rates were measured to be $1.4\times10^{-3}$ gm/cm$^2$-day and $9.6\times10^{-4}$ gm/cm$^2$-day respectively.

The foregoing description of a preferred embodiment of the invention has been presented for purposes of illustration and description and is not intended to be exhaustive or to limit the invention to the precise form disclosed. It was chosen and described in order to best explain the principles of the invention and their practical application to thereby enable others skilled in the art to best utilize the invention in various embodiments and with various modifications as are suited to the particular use contemplated. It is intended that the scope of the invention be defined by the claims appended hereto.

We claim:

1. A method for incorporating radioactive phosphoric acid solutions in concrete comprising:

(a) first neutralizing a phosphoric acid solution containing Cobalt-60 with $Ca(OH)_2$ and thereby forming a precipitate, said precipitate having the formula $Ca_{10}(PO_4)_6(OH)_2$ and the crystal structure of hydroxyapatite, and then (b) mixing said precipitate with portland cement and thereby forming concrete.

2. The method of claim 1 wherein said phosphoric acid solution contains 6% phosphoric acid.

3. The method of claim 1 wherein said precipitation is carried out at a pH of from 7.5 to 8.5.

4. The method of claim 1 wherein the precipitate and the portland cement are mixed in proportions by weight ranging from 3:1 to 1:1.

5. The method of claim 1 wherein the precipitate is separated from the supernate and dried before the mixing with portland cement.

* * * * *